US008337341B1

(12) United States Patent
Huang

(10) Patent No.: US 8,337,341 B1
(45) Date of Patent: Dec. 25, 2012

(54) ARROW TIP

(76) Inventor: Dorge Huang, Henry, IL (US)

( * ) Notice: Subject to any disclaimer, the term of this patent is extended or adjusted under 35 U.S.C. 154(b) by 0 days.

(21) Appl. No.: 13/292,895

(22) Filed: Nov. 9, 2011

(51) Int. Cl.
*F42B 6/08* (2006.01)

(52) U.S. Cl. ..... 473/582

(58) Field of Classification Search ..... 411/324; 473/578, 582, 583, 585
See application file for complete search history.

(56) References Cited

U.S. PATENT DOCUMENTS 5,516,117 A * 5/1996 Rangel ..... 473/578
7,918,634 B2 * 4/2011 Conrad et al. ..... 411/377
7,980,801 B2 * 7/2011 Kawano ..... 411/402
8,016,703 B1 * 9/2011 Kronengold et al. ..... 473/582
2007/0026980 A1 * 2/2007 Grace et al. ..... 473/582

* cited by examiner

*Primary Examiner* — John Ricci

(57) ABSTRACT

An arrow point includes a tip portion, a neck portion, a threaded portion, a front O-ring, and a rear O-ring. The depth of the front O-ring groove and the rear O-ring groove are equal to a dimension that is at least 50% of the thickness of the cross section of front O-ring and rear O-ring. The grooves have a depth of at least 50% of the cross sectional thickness of the O-rings, the grooves contain the O-rings and prevent the O-rings from being pulled out of the grooves. The cross section diameter of the neck portion of the arrow point is less than the inside diameter of the arrow insert. The compression forces on the front O-ring and the rear O-ring that concentrically align the arrow point within the arrow insert also prevent the arrow point from vibrating loose within the arrow insert.

18 Claims, 1 Drawing Sheet

ARROW TIP

BACKGROUND OF THE INVENTION

1. Field of the Invention

The present invention relates generally to archery arrows and more specifically to arrow tip for an archery arrow.

2. Discussion of the Prior Art

Historically there have been many advancements in the art of archery. From the earliest time when man first affixed a flint point to the end of a slender stick, and propelled it form a bow, he has strived to increase the performance and accuracy of the arrow. New materials with greater strength, lighter weight projectiles, and aerodynamic vanes have all helped to increase performance, but there has always been an issue with dynamic forces on the arrow itself, and the consistent alignment of the arrow tip.

The present invention takes arrow performance to an all-new level, by concentrically aligning the arrow point.

Prior art of an arrow point has been good at best, where the neck of the point and the threads may not be concentrically aligned with the arrow insert, or the tip itself. All the archer could hope for was to screw the arrow tip into the arrow insert, and hope that they would align well enough to make the arrow fly with acceptable accuracy. More recently, an O-ring was slid on the neck of some broadhead hunting arrow tips. This O-ring was compressed between the base of the arrow tip and the arrow insert. Though this helped with alignment of the broadhead blades at the front of the arrow and the vanes at the rear of the arrow, it did nothing to help concentrically align the head itself.

The present invention of the arrow tip allows for the use of O-rings that are positioned on the neck of the arrow point, so as to concentrically align the point as it is screwed into the arrow insert. Another benefit of the use of O-rings is the prevention of the arrow tip from loosening during repeated use.

SUMMARY OF THE INVENTION

An arrow point includes a tip portion, a neck portion, a threaded portion, a front O-ring, and a rear O-ring. The front O-ring and the rear O-ring have an outside diameter that is larger than the outside diameter of the neck. The depth of the front O-ring groove and the rear O-ring groove are equal to a dimension that is at least 50% of the thickness of the cross section of front O-ring and rear O-ring. The grooves have a depth of at least 50% of the cross sectional thickness of the O-rings, the grooves contain the O-rings and prevent the O-rings from being pulled out of the grooves when the arrow point is inserted into one end of an arrow insert. The cross section diameter of the neck portion of the arrow point is less than the inside diameter of the arrow insert. The outside diameter of the front O-ring and the rear O-ring is at least equal to, or greater than, the inside diameter of the arrow insert, thus concentrically aligning the arrow point within the arrow insert. A threaded diameter is formed in the other end of the arrow insert. The threaded diameter is sized to threadably receive the threaded portion of the arrow tip. An arrow shaft includes an inner perimeter and an outer perimeter. The compression forces on the front O-ring and the rear O-ring that concentrically align the arrow point within the arrow insert also prevent the arrow point from vibrating loose within the arrow insert.

DETAILED DESCRIPTION OF THE PREFERRED EMBODIMENTS

Figure 1:
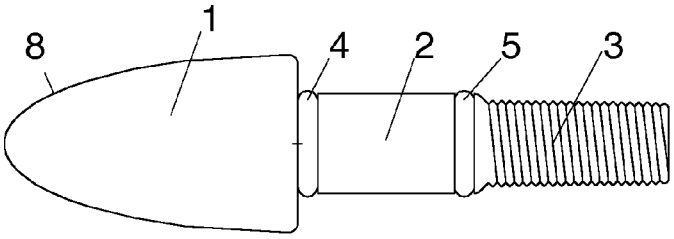
FIG. 1 is a side view of an arrow point of the present invention
Figure 2:
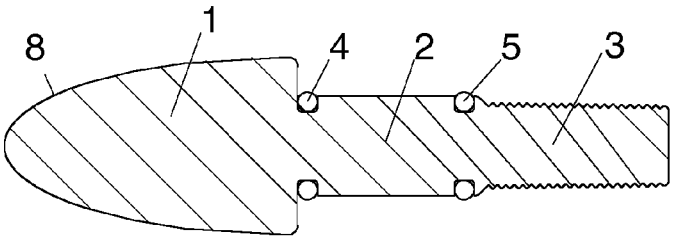
FIG. 2 is a cross section view of an arrow point of the present invention, when O-rings are installed.
Figure 3:
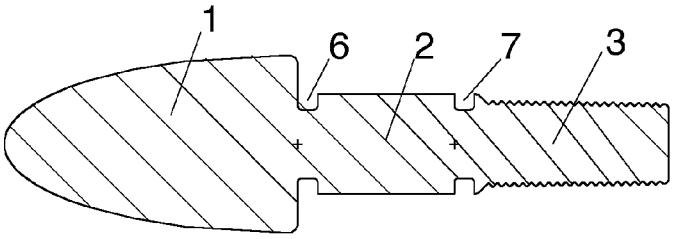
FIG. 3 is a cross section view of an arrow point of the present invention, when no O-rings are installed.
Figure 4:
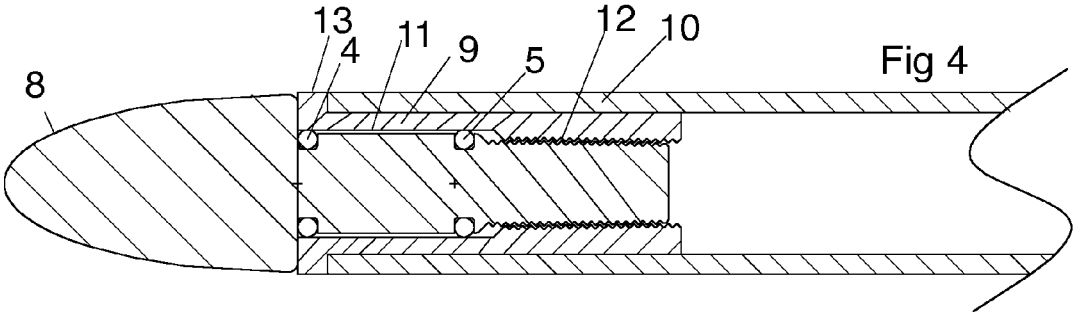
FIG. 4 is a cross section view of an arrow point of the present invention retained in an arrow insert and the arrow inserted retained in an arrow shaft.

In FIG. 1, a view an arrow point 8 includes a tip portion 1, a neck portion 2, a threaded portion 3, a front O-ring 4, and a rear O-ring 5. In FIG. 2, a view of the cross section of an arrow point 8 of the present invention is shown. The front O-ring 4 and rear O-ring 5 include an outside diameter that is larger than the outside diameter of the neck 2. In FIG. 3, a cross section view of an arrow point 8 of the present invention is shown, without O-rings. The depth of the front O-ring groove 6 and the rear O-ring groove 7 are equal to a dimension that is at least 50% the thickness of the cross section of front O-ring 4 and rear O-ring 5. The grooves have a depth of at least 50% of the cross section thickness said O-rings, the grooves contain the O-rings and prevent the O-rings from being pulled out of the grooves when the arrow point is inserted into an arrow insert 9. FIG. 4 is a view of an arrow point 8 of the present invention coupled into an arrow insert 9. The cross section diameter of the neck portion 2 of the arrow point 8 is less than an inside diameter 11 formed in one end of the arrow insert 9. The outside diameter of the front O-ring 4 and rear O-ring 5 is at least equal to, or greater than, the inside diameter 11 of the arrow insert 9, thus concentrically aligning the arrow point 8 within the arrow insert 9. A threaded diameter 12 is formed in the other end of said arrow insert 9. The threaded diameter 12 is sized to threadably receive the threaded portion 3 of the arrow tip 8. The arrow insert 9 also includes a shoulder 13 formed on the one end thereof. An arrow shaft 10 includes an inner perimeter and an outer perimeter. The shoulder 13 is substantially the same diameter as the outer perimeter of the arrow shaft 10. The compression forces on front O-ring 4 and rear O-ring 5 that concentrically align the arrow point 8 within the arrow insert 9 also prevent the arrow point 8 from vibrating loose within the arrow insert 9.

What I claim is:

1. An archery arrow comprising:

an arrow shaft having an outer perimeter and an inner perimeter;

an arrow insert having an outer perimeter and inner perimeter, said outer perimeter of said arrow insert is sized to be receive by said inner perimeter of said arrow shaft;

two o-rings;

an arrow point includes a tip portion and a neck portion, said tip portion extends from said neck portion, two o-ring grooves are formed in said neck portion, said two o-ring grooves are sized to receive said two o-rings, said inner perimeter of said arrow insert is sized to receive an outer perimeter of said two o-rings.

2. The archery arrow of claim 1, further comprising:

a threaded portion extends from the other end of said neck portion, said threaded portion is engaged with said inner perimeter of said arrow insert.

3. The archery arrow of claim 1 wherein:

said two o-rings grooves have a depth which is at least 50% of a thickness of said two o-rings.

4. The archery arrow of claim 1 wherein:

an outer perimeter of said two o-rings is the same size as said inner perimeter of said arrow insert.

5. The archery arrow of claim 1 wherein:

an outer perimeter of said two o-rings is greater than said inner perimeter of said arrow insert.

6. The archery arrow of claim 1 wherein:

a shoulder is formed on said one end of said arrow insert, said shoulder is substantially the same size as said outer perimeter of said arrow shaft.

7. An archery arrow comprising:

an arrow shaft having an outer perimeter and an inner perimeter;

an arrow insert having an outer perimeter and inner perimeter, said outer perimeter of said arrow insert is sized to be receive by said inner perimeter of said arrow shaft;

a front o-ring and a rear o-ring;

an arrow point includes a tip portion and a neck portion, said tip portion extends from one end of said neck portion, a front o-ring groove is formed in substantially said one end of said neck portion, a rear o-ring groove is formed in substantially the other end of said neck portion, said front o-ring is retained in said front o-ring groove, said rear o-ring is retained in said rear o-ring groove, said inner perimeter of said arrow insert is sized to receive an outer perimeter of said front and rear o-rings, wherein said front and rear o-rings concentrically align said arrow point with said arrow insert.

8. The archery arrow of claim 7, further comprising:

a threaded portion extends from the other end of said neck portion, said threaded portion is engaged with said inner perimeter of said arrow insert.

9. The archery arrow of claim 7 wherein:

said front and rear o-rings grooves have a depth which is at least 50% of a thickness of said front and rear o-rings.

10. The archery arrow of claim 7 wherein:

an outer perimeter of said first and second o-rings is the same size as said inner perimeter of said arrow insert.

11. The archery arrow of claim 1 wherein:

an outer perimeter of said first and second o-rings is greater than said inner perimeter of said arrow insert.

12. The archery arrow of claim 1 wherein:

a shoulder is formed on said one end of said arrow insert, said shoulder is substantially the same size as said outer perimeter of said arrow shaft.

13. An archery arrow comprising:

an arrow shaft having an outer perimeter and an inner perimeter;

an arrow insert having an outer perimeter and inner perimeter, said outer perimeter of said arrow insert is sized to be receive by said inner perimeter of said arrow shaft;

a front o-ring and a rear o-ring;

an arrow point includes a tip portion, a neck portion and a means for engagement, said tip portion extends from one end of said neck portion, said means for engagement extends from the other end of said neck portion, a front o-ring groove is formed in substantially said one end of said neck portion, a rear o-ring groove is formed in substantially the other end of said neck portion, said front o-ring is retained in said front o-ring groove, said rear o-ring is retained in said rear o-ring groove, said inner perimeter of said arrow insert is sized to receive an outer perimeter of said front and rear o-rings, wherein said front and rear o-rings concentrically align said arrow point with said arrow insert.

14. The archery arrow of claim 13, further comprising:

said means for engagement is a threaded portion, said threaded portion is engaged with said inner perimeter of said arrow insert.

15. The archery arrow of claim 13 wherein:

said front and rear o-rings grooves have a depth which is at least 50% of a thickness of said front and rear o-rings.

16. The archery arrow of claim 13 wherein:

an outer perimeter of said first and second o-rings is the same size as said inner perimeter of said arrow insert.

17. The archery arrow of claim 13 wherein:

an outer perimeter of said first and second o-rings is greater than said inner perimeter of said arrow insert.

18. The archery arrow of claim 13 wherein:

a shoulder is formed on said one end of said arrow insert, said shoulder is substantially the same size as said outer perimeter of said arrow shaft.

* * * * *